US010337248B1

(12) United States Patent
Lanzafame

(10) Patent No.: US 10,337,248 B1
(45) **Date of Patent: *Jul. 2, 2019**

(54) ADJUSTABLE LADDER EXTENSION

(71) Applicant: Philip F. Lanzafame, Poulsbo, WA (US)

(72) Inventor: Philip F. Lanzafame, Poulsbo, WA (US)

(73) Assignee: Philip F. Lanzafame, Poulsbo, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/038,324

(22) Filed: Jul. 18, 2018

Related U.S. Application Data

(63) Continuation of application No. 15/258,795, filed on Sep. 7, 2016, now Pat. No. 10,047,561.

(60) Provisional application No. 62/215,613, filed on Sep. 8, 2015.

(51) Int. Cl.
*E06C 7/44* (2006.01)
*E06C 7/42* (2006.01)

(52) U.S. Cl.
CPC ..... *E06C 7/44* (2013.01); *E06C 7/42* (2013.01); *E06C 7/423* (2013.01)

(58) Field of Classification Search
USPC ..... 182/201, 204
See application file for complete search history.

(56) References Cited

U.S. PATENT DOCUMENTS 1,393,536 A * 10/1921 Hunt ..... E06C 7/44 182/203
1,609,257 A * 11/1926 Lazear ..... E06C 7/44 182/205
2,962,317 A * 11/1960 Morse ..... F16B 5/02 29/DIG. 105
4,412,599 A * 11/1983 McCrudden ..... E06C 1/345 182/201
4,606,432 A * 8/1986 Belt ..... E06C 7/44 182/204
5,064,024 A * 11/1991 Barham ..... E06C 7/44 182/111
5,232,067 A * 8/1993 Griffith ..... E06C 7/44 182/201
5,325,936 A * 7/1994 Baker ..... E06C 7/44 182/111
5,678,656 A * 10/1997 Lanzafame ..... E06C 7/44 182/111
6,109,851 A * 8/2000 Bauer ..... C21D 9/0093 411/387.7

(Continued)

FOREIGN PATENT DOCUMENTS

CA 2233713 A1 * 10/1999 ..... E06C 7/44

*Primary Examiner* — Marcus Menezes
(74) *Attorney, Agent, or Firm* — Tucker Ellis LLP; Carlos Garritano; Patrick Clunk

(57) ABSTRACT

Provided is an adjustable extension for attachment to a ladder leg. The extension has an extension body and a friction surface that presses against the extension body to prevent movement of the extension body. The extension also includes a retainer that engages a retainer catch attached to the extension body to releasably hold the extension body in a retraced position, thereby allowing for one-handed operation and easy transportation of the ladder.

19 Claims, 10 Drawing Sheets

(56) References Cited

U.S. PATENT DOCUMENTS

| | | | | |
|---|---|---|---|---|
| 6,478,113 | B1 * | 11/2002 | Ellison | E06C 7/44 182/200 |
| 6,948,591 | B2 * | 9/2005 | Scott | E06C 7/44 182/201 |
| 9,010,491 | B2 * | 4/2015 | Trang | E06C 7/44 182/109 |
| 2005/0067224 | A1 * | 3/2005 | Brewster | E06C 7/44 182/108 |
| 2008/0190697 | A1 * | 8/2008 | Skurkis | E06C 7/44 182/204 |

* cited by examiner

ADJUSTABLE LADDER EXTENSION

RELATED APPLICATIONS

This application is a continuation of U.S. patent application Ser. No. 15/258,795 filed Sep. 7, 2016, which claims the benefit of U.S. Provisional Application No. 62/215,613 filed Sep. 8, 2015, which are hereby incorporated herein by reference.

FIELD OF INVENTION

The present invention relates generally to a removable attachment for each leg of a ladder, and more particularly to a removable attachment to each leg of a ladder and each removable attachment extends a height of each leg of the ladder to adjust and compensate for uneven surfaces.

BACKGROUND

In construction, painting, utility servicing, building maintenance and other occupations where a ladder is used to perform work, the placement of the ladder is often a problem. For example, the ladder may need to be placed upon uneven or inclined surfaces for work to be performed, such as on a stair, which results in rails of the ladder not being positioned vertically leading to the ladder falling. To position the rails of the ladder vertically to reduce injury, a ladder leveling device may be used.

SUMMARY OF INVENTION

The present application provides an adjustable extension for attachment to a ladder leg. The extension has an extension body and a friction surface that presses against the extension body to prevent movement of the extension body. The extension also includes a retainer that engages a retainer catch attached to the extension body to releasably hold the extension body in a retraced position, thereby allowing for one-handed operation and easy transportation of the ladder.

In an embodiment, the adjustable extension includes a housing attachable to the ladder leg, the housing having a through passage, an extension body extending through the through passage of the housing and movable relative to the housing from a retracted position to one or more extension positions to adjust the ladder leg, a retainer attached to or integrally formed with the housing or the extension body, and a retainer catch attached to or integrally formed with the other of the housing or the extension body, wherein the retainer engages the retainer catch in the retracted position to retain the extension body.

In another embodiment, the adjustable includes a housing attachable to the ladder leg, the housing having a through passage extending in a longitudinal direction, an extension body extending through the through passage of the housing and movable relative to the housing in the longitudinal direction from a retracted position to one or more extension positions to adjust the ladder leg, a screw-clamp secured to and movable relative to the housing and having a rod with an axis perpendicular to the longitudinal direction, and a friction surface disposed within the through passage and positioned between the extension body and the screw-clamp, wherein movement of the screw clamp in a direction perpendicular to the longitudinal direction and towards the extension body causes the friction surface to press against the extension body to prevent movement of the extension relative to the housing.

In still another embodiment the adjustable extension includes a housing attachable to the ladder leg, the housing having a through passage extending in a longitudinal direction, an extension body extending through the through passage of the housing and movable relative to the housing in the longitudinal direction from a retracted position to one or more extension positions to adjust a height of the ladder leg, a screw-clamp secured to and movable relative to the housing and having a rod with an axis perpendicular to the longitudinal direction, a friction surface disposed within the through passage and positioned between the extension body and the screw-clamp, wherein movement of the screw clamp in a direction perpendicular to the longitudinal direction and towards the extension body causes the friction surface to press against the extension body to prevent movement of the extension relative to the housing, a retainer attached to the housing, and a retainer catch attached to the extension body, wherein the retainer engages the retainer catch in the retracted position to retain the extension body.

The foregoing and other features of the application are described below with reference to the drawings.

DETAILED DESCRIPTION

The principles of the present application relate to stabilizing, extending, and leveling a leg of a ladder, and thus will be described below in this context. It will be appreciated that the principles of the application may be applicable to other apparatuses requiring stabilizing, extending, and leveling, such as scaffolding.

Figure 1:
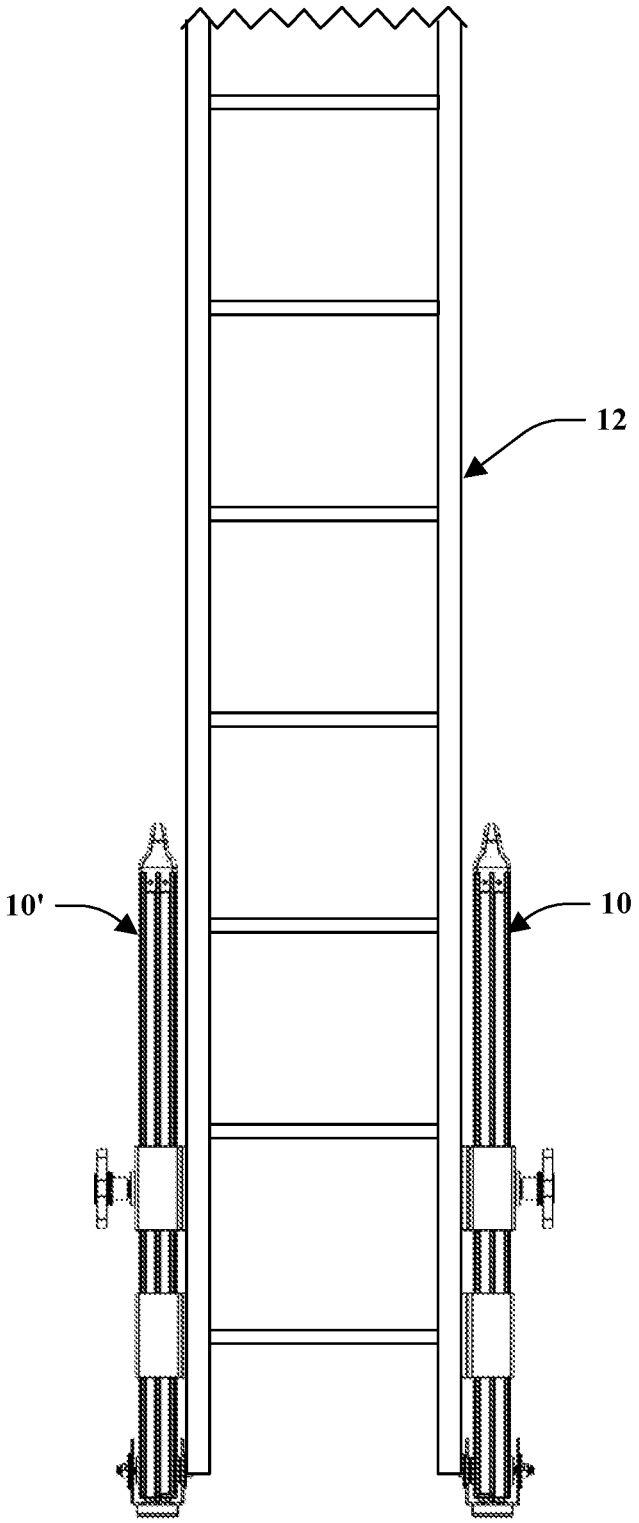
FIG. 1 is a perspective view of an exemplary adjustable extension attached to a leg of a ladder.

Referring initially to FIG. 1, an exemplary adjustable extension is illustrated generally at reference numeral 10. The adjustable extension 10 (also referred to as "extension 10") is connected to a ladder 12, which may be any suitable ladder, as will be described below. In use, one extension 10 may be connected to a left leg of the ladder 12 and one extension 10 may be connected to a right leg of the ladder 12 to provide stabilization, extension, and leveling to the ladder. In an embodiment, a first extension 10 is coupled to a first leg of a ladder and a second extension 10' is coupled to a second leg of a ladder. The extensions may be any suitable length, such as two to five feet. It is to be appreciated that if the following description describes an extension 10, such description can apply for an additional extension 10'. It is to be further appreciated that the extension 10 can be coupled to an inside of a leg of a ladder or an outside of a ladder of a leg. For example, a first extension 10 and a second extension 10' can be coupled to an inside of a first leg and an inside of a second leg respectively. In another example, a first extension 10 and a second extension 10' can be coupled to an outside of a first leg and an outside of a second leg respectively. In still another example, a first extension 10 and a second extension 10' can be coupled to an inside of a first leg and an outside of a second leg respectively or vice versa. It is to be appreciated that, in an embodiment, each extension 10 and 10' can be permanently coupled to a ladder.

Conventional ladders and attachable legs use a hand-tightened screw clamp mechanism that engages an opening which is cumbersome and robust. Moreover, these conventional ladders and attachable legs have set holes and requires pins, wherein the pins can be lost or misplaced, and/or hard to use or set into position/align. Further, conventional ladders and attachable legs have the adjustable heights dictated by the position of the set holes which may not be the height a user needs. The subject innovation and extension 10 overcomes these deficiencies by the features and techniques described herein.

Figure 2:
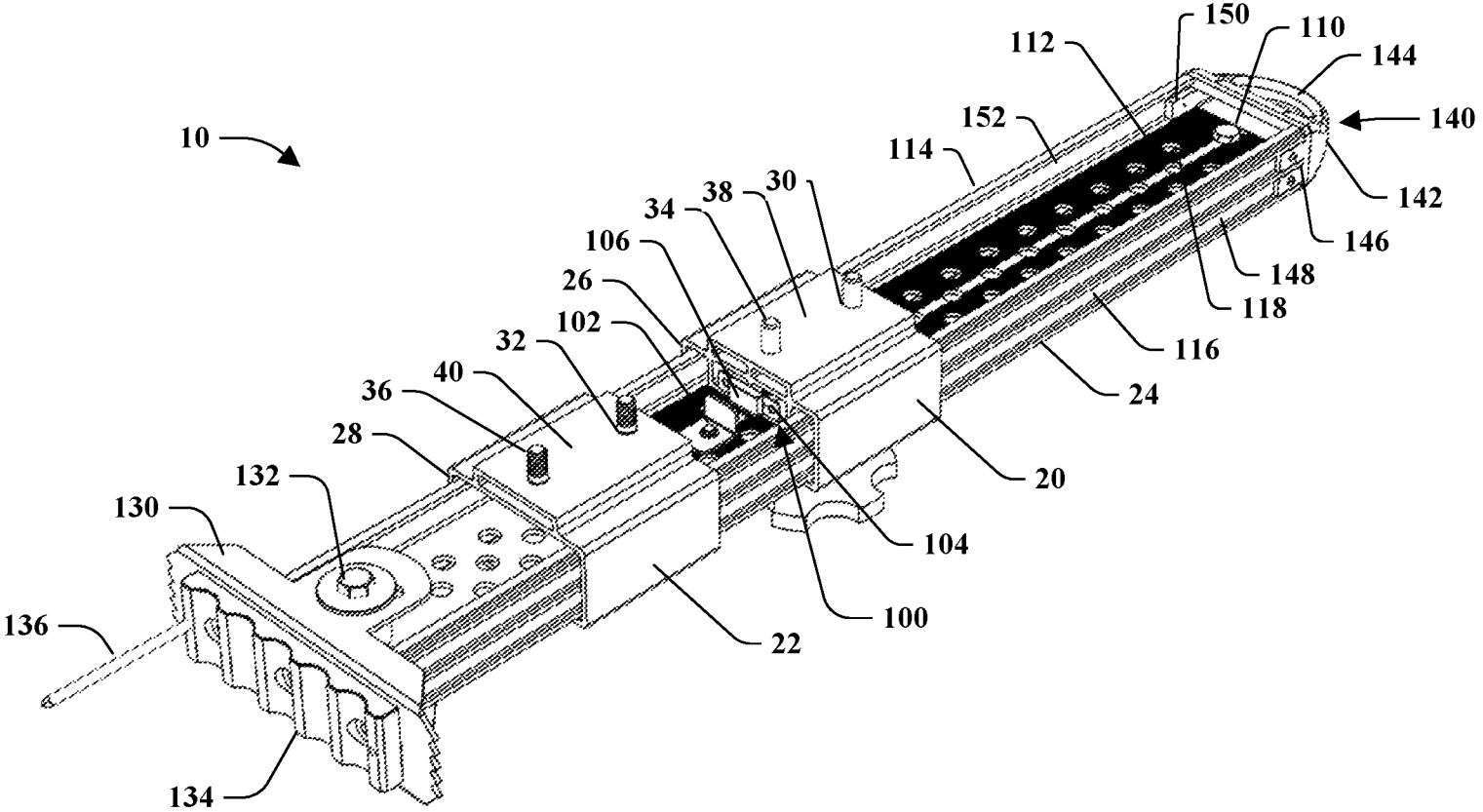
FIG. 2 is a rear perspective view of the adjustable extension in a retracted position.

Turning now to FIGS. 2-13, and initially to FIG. 2, the adjustable extension 10 includes an upper housing 20, a lower housing 22, and an extension body 24. The upper and lower housings 20 and 22 are configured to be spaced from one another in a longitudinal direction along a length of the ladder. The housings 20 and 22 each have a respective through passage 26, 28 extending in the longitudinal direction and through which the extension body 24 is movable relative to the housings in the longitudinal direction, and respective pairs of longitudinally spaced openings 30 and 32 on backs of the housings 20 and 22 that receive bolts 34 and 36 respectively. The openings 30 and 32 are spaced a distance of openings along a side of the ladder so that the fasteners 34 and 36 can extend through the openings 30 and 32 and through the openings in the ladder to removably secure the upper and lower housings 20 and 22 to the ladder 12. In the illustrated embodiment, each housing 20 and 22 includes an integral spacer portion 38 and 40 having the openings 30 and 32 to provide spacing between the leg of the ladder 12 and the extension 10.

Figure 3:
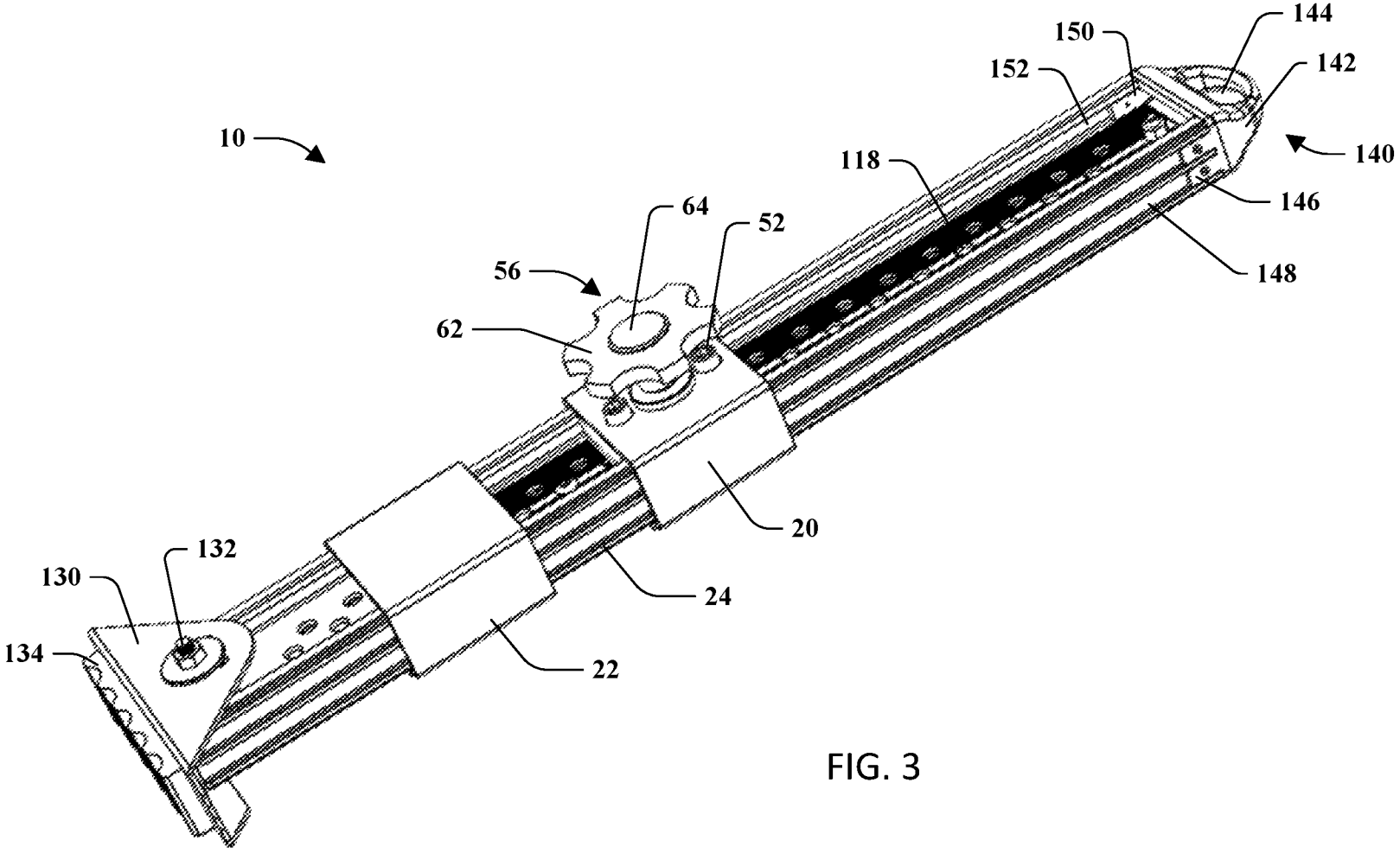
FIG. 3 is a front perspective view of the adjustable extension.
Figure 4:
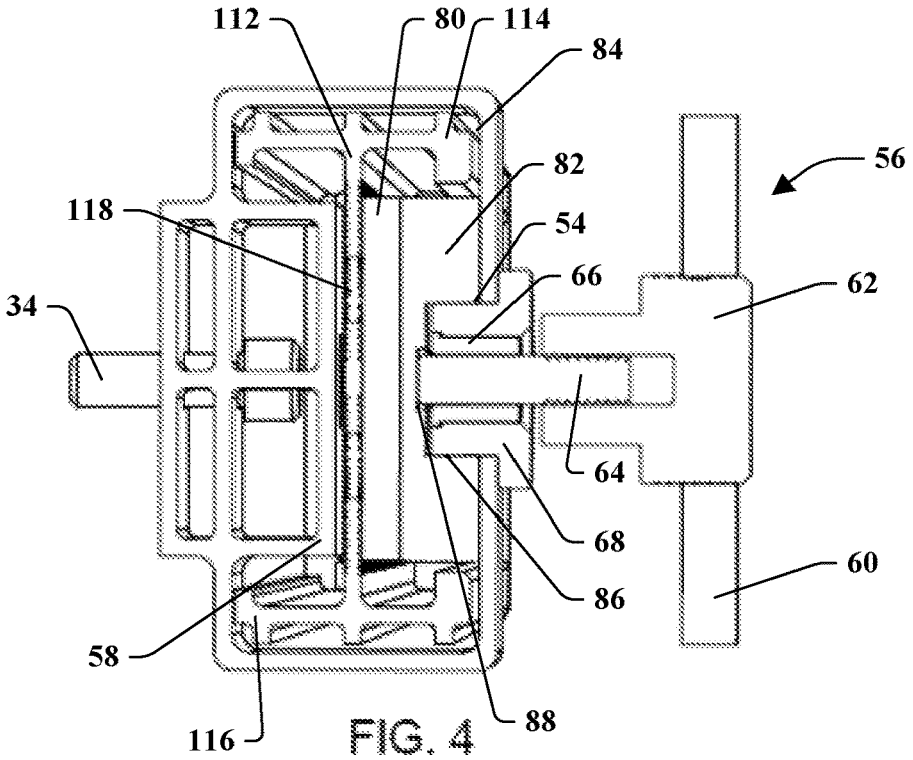
FIG. 4 is a cross-sectional view taken about line 4-4 in FIG. 8.
Figure 5:
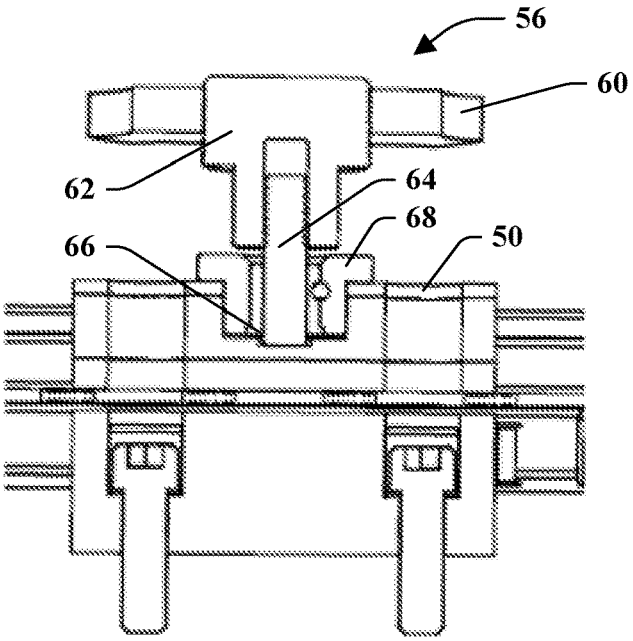
FIG. 5 is a cross-sectional view taken about line 5-5 in FIG. 8.

Turning now to FIGS. 3-5, the upper housing 20 additionally includes a pair of spaced openings 50 on a front of the housing for receiving respective shear supports 52, an opening 54 for receiving a screw clamp assembly 56, and a guide 58. The guide 58 projects from the back of the upper housing 20 into the through passage 26 in a direction opposite the direction that the spacer portion 38 projects from the back. The guide 58 serves as an area to house a head of the fasteners 34 and to guide the extension body 24 as the extension body 24 is moved.

The screw clamp assembly 56 includes a palm wheel 60 mated to a torque limiting knob 62 to rotate the knob, a rod 64 mated to the torque limiting knob 62 to be rotated by the knob 62 and having an axis perpendicular to the longitudinal axis, a push nut 66 having a through passage with threads for mating with threads on the rod 64, and a welded insert 68 welded to the upper housing 20 to secure the screw clamp assembly to the housing 20. The torque limiting knob 62 is configured to release engagement with the rod 64 when a torque above a predefined criteria is applied to the rod 64 to prevent the torque above the predefined criteria from being passed to the rod 64. In an example, the torque can be above forty-two pounds. In another example, the torque can be above 20 pounds. When the torque limiting knob 62 is tightened, it is configured to provide an audio indication to the user that the rod 64 is tight, for example by clicking, and further rotation of the knob 62 will not tighten the rod 64 further. In an embodiment the torque limiting knob 62 may include a spring with a spring-force that opposes a release of engagement of the knob 62 with the rod 64 and releases engagement with the rod 64 when a torque is applied that exceeds the spring-force.

Figure 14:
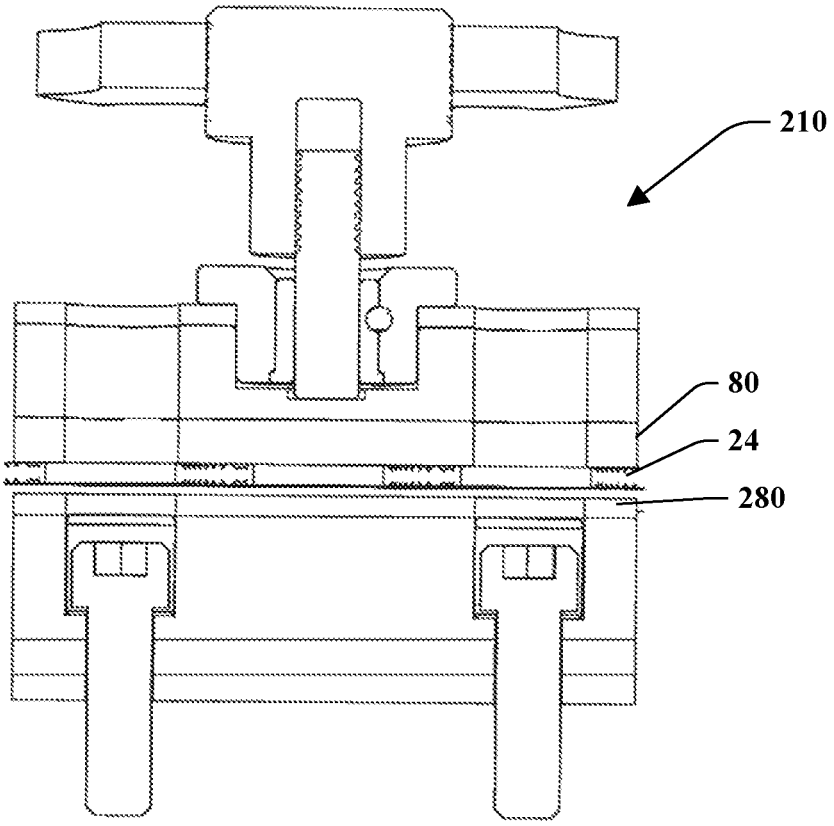
FIG. 14 is a cross-sectional view of a portion of another exemplary adjustable extension.

Disposed within the through passage 26 of the upper housing 20 and coupled to the screw clamp assembly 56 is a friction surface 80, which may be a suitable material such as a low durometer rubber, and a shoe 82, which may be a suitable material such as metal. By way of example and not limitation, the metal or material can be aluminum, steel, carbon fiber, plastic, among others. The friction surface 80 may be configured to increase its friction after it has been compressed, thereby providing a more secure grip. The shoe 82 is positioned in the through passage 26 with a first side abutting an inner surface 84 of the upper housing 20 and a second side opposite the first side abutting the friction surface 80. The friction surface 80 and shoe 82 each include a pair of openings corresponding to the openings 50 for receiving a respective one of the shear supports 52. The shear supports 52 couple the friction surface 80 and the shoe 82 to the upper housing 20 and receive a shear force applied to the shoe 82 by the extension body 24 and transmit the shear force to the ladder leg other than through the rod 64. The shoe 82 also includes a first opening 86 corresponding to the opening 54 for receiving the push nut 66 and the welded insert 68 and a second opening 88 adjacent the first opening 86 extending partially through the shoe 82 for receiving the rod 64. An end of the rod 64 may be coupled to the shoe 82, for example by a ball and socket attachment, such that when the rod is moved away from the friction surface 80, the rod will pull the shoe 82 away from the friction surface 80. In an embodiment, shown in FIG. 14, an extension 210 is shown that is substantially the same as the extension 10, except the extension 210 additionally includes friction material 280 that can press against the extension body 24 and/or into one or more of the openings of the extension body 24.

As shown in FIG. 2, secured to a bottom of the upper housing 20 or integrally formed with the housing is a retainer 100, and secured to the extension body 24 or integrally formed with the extension body 24 is a retainer catch 102. The retainer 100 is configured to engage the retainer catch 102 when the extension body 24 is in a retracted position to automatically hold the extension body 24 in position relative to the upper housing 20 without having to engage the screw clamp assembly 56 and friction surface 80, and is force releasable to disengage from the retainer catch 102. In this way, when the screw clamp assembly 56 is disengaged, the extension body 24 can be moved to the retracted position and remain in position to allow easy transportation of the ladder. When the user has the ladder in its desired position, the user can apply a force in the downward direction, such as by hitting a side of the extension body 24, and the extension body 24 will be released to move downward without damaging the retainer 100.

In the illustrated embodiment, the retainer 100 includes a holder 104 coupled to the bottom of the upper housing 20 and a magnet 106 coupled to the holder 104 to pull on a magnetic surface of the retainer catch 102, which is illustrated as an L-shaped member having one side abutting and secured to the extension body 24 and another side extending perpendicular to the extension body 24. It will be appreciated that the retainer 100 may be secured to the extension body 24 and the retainer catch 102 secured to the upper housing 20, and the retainer and retainer catch may be adjustable on the extension based on a user's preferences. For example, a user may adjust the retainer and retainer catch to a particular location on the extension 10 based on his or her use of the ladder and extensions 10 and 10' and/or the particular job being performed.

In another embodiment, the retainer 100 may be a friction catch that holds the extension body 24 by friction and releases the extension body 24 to slide freely when a force is applied in the downward direction. In still another embodiment, the retainer 100 may be a spring catch that holds the extension body 24 by spring force and releases the extension body 24 to slide freely when a force is applied in the downward direction and the force exceeds the spring force. In a further embodiment, one of the housing 20 and extension body 24 may include a protrusion and the other may include a recess for softly engaging the protrusion in the retracted position. In yet another embodiment, the retainer and retainer catch can engage one another and be releasable upon actuation of a release mechanism. For instance, the release mechanism can be a button that, upon being depressed, releases the retainer and retainer catch to allow movement of the extension. In a particular embodiment, the release mechanism can be located on a top portion of the ladder or at a height of an average person so as to facilitate accessing the release mechanism.

Figure 6:
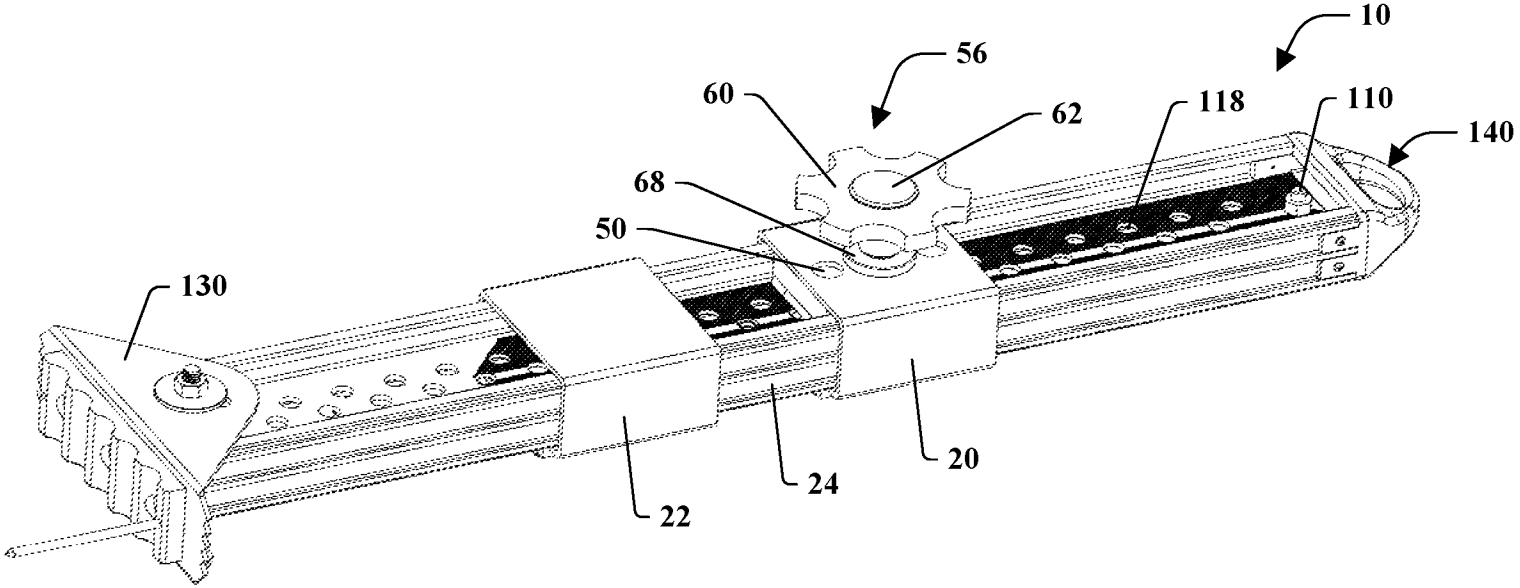
FIG. 6 is a front perspective view of the adjustable extension in an intermediate position.
Figure 7:
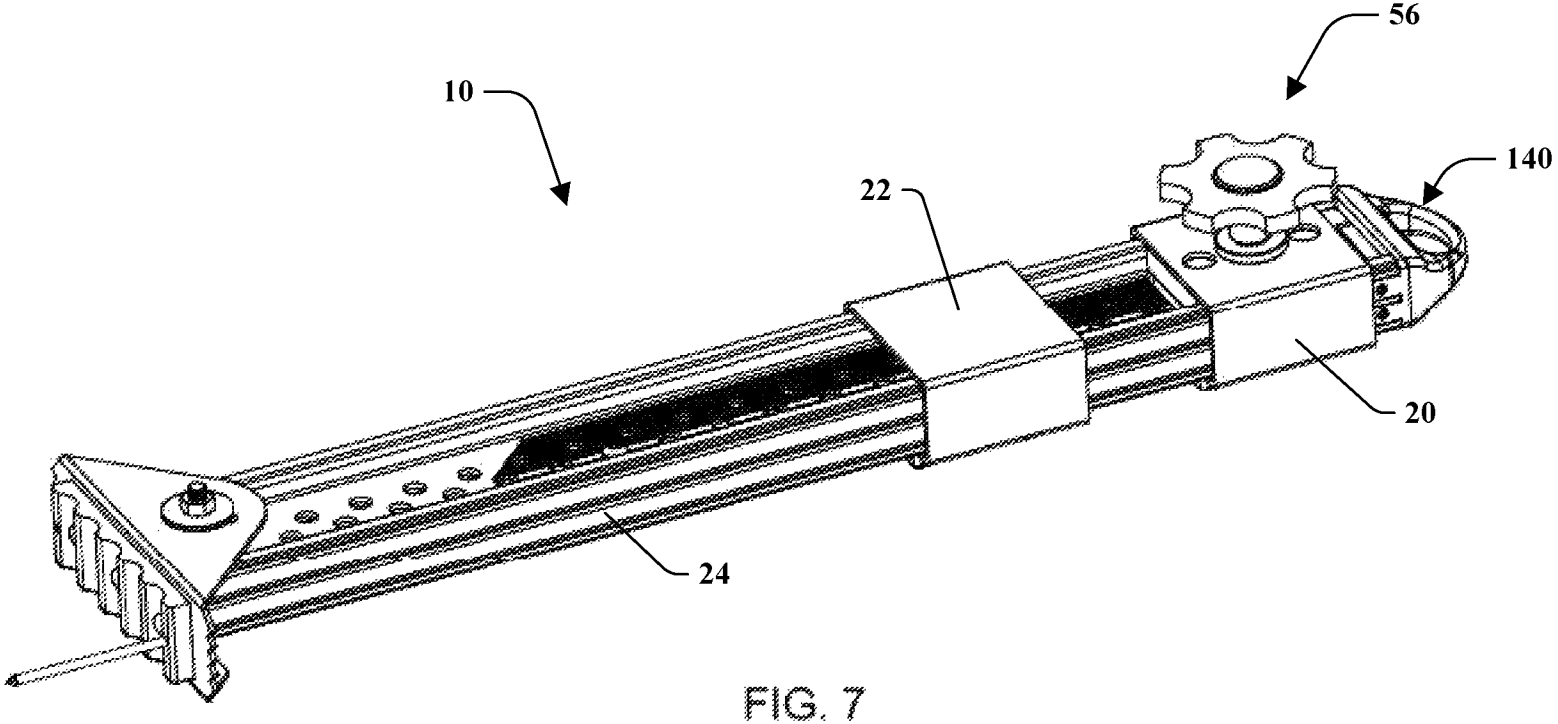
FIG. 7 is a front perspective view of the adjustable extension in an extended position.
Figure 8:
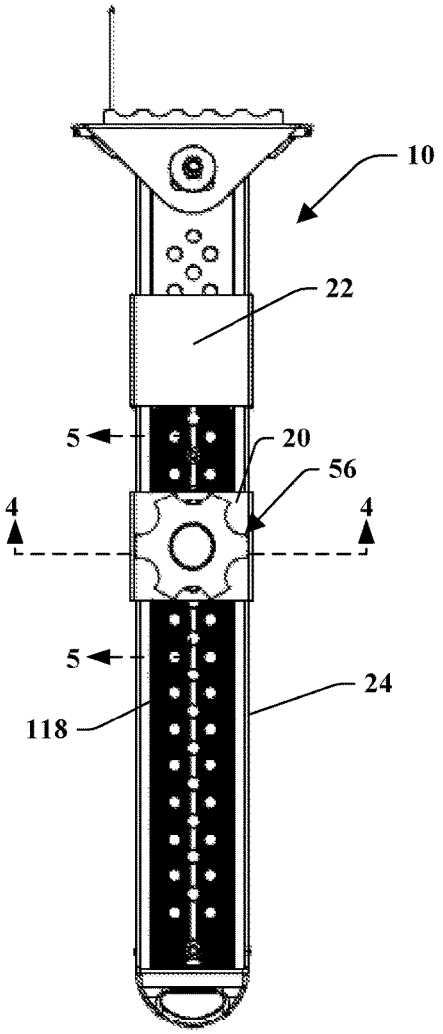
FIG. 8 is a front view of the adjustable extension.
Figure 9:
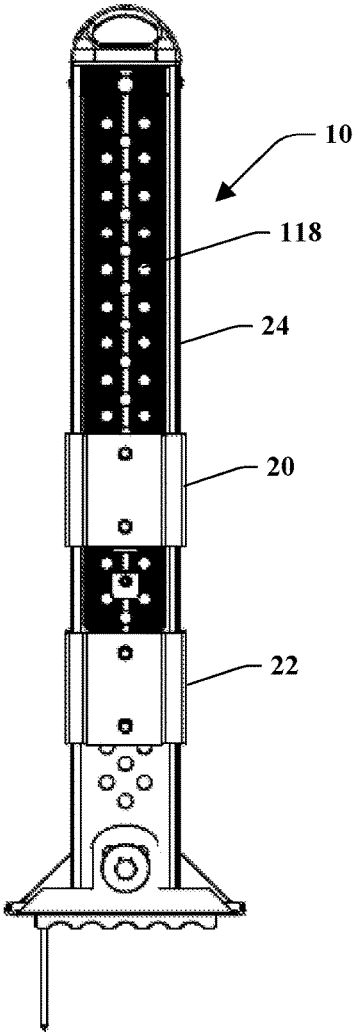
FIG. 9 is a rear view of the adjustable extension.
Figure 10:
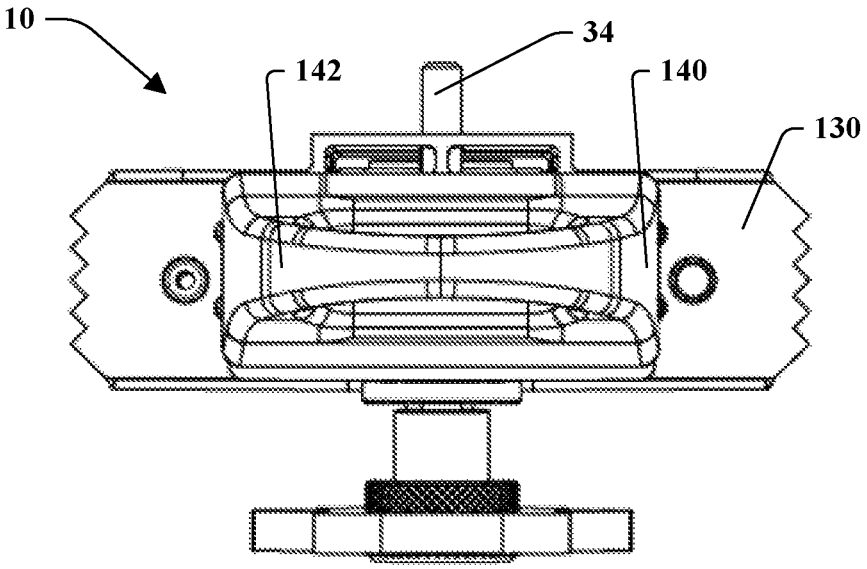
FIG. 10 is a top view of the adjustable extension.
Figure 11:
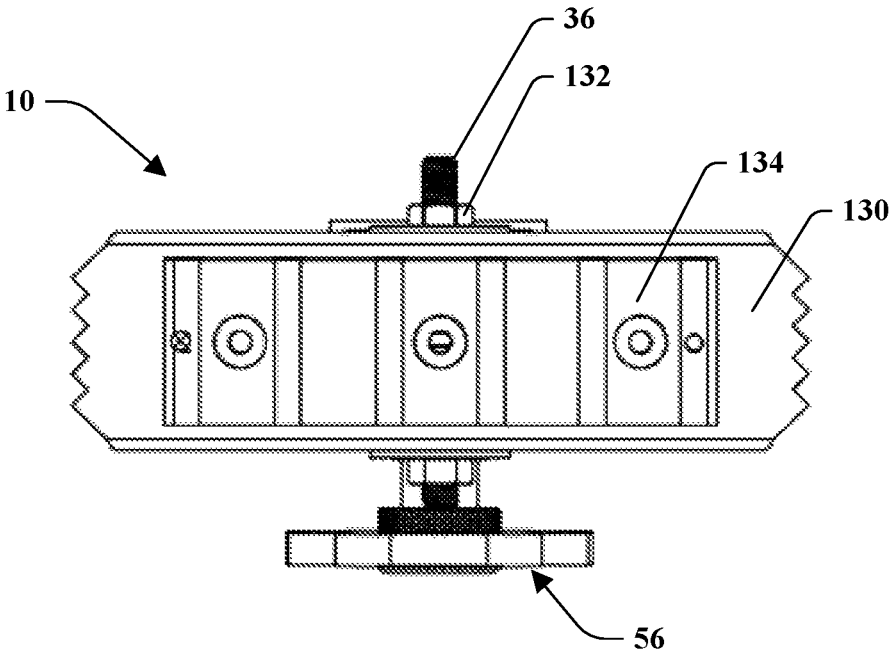
FIG. 11 is a bottom view of the adjustable extension.
Figure 12:
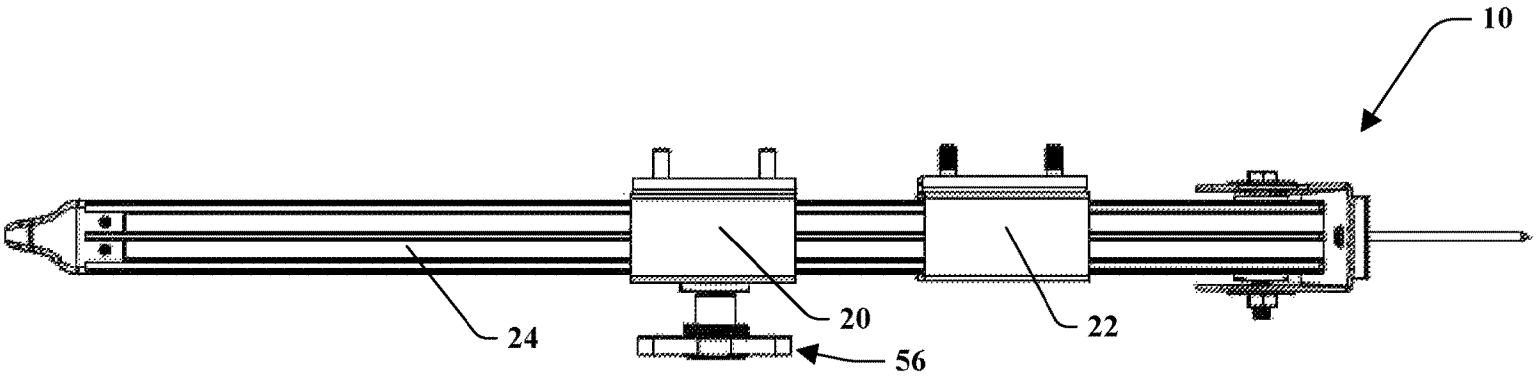
FIG. 12 is a right side view of the adjustable extension.
Figure 13:
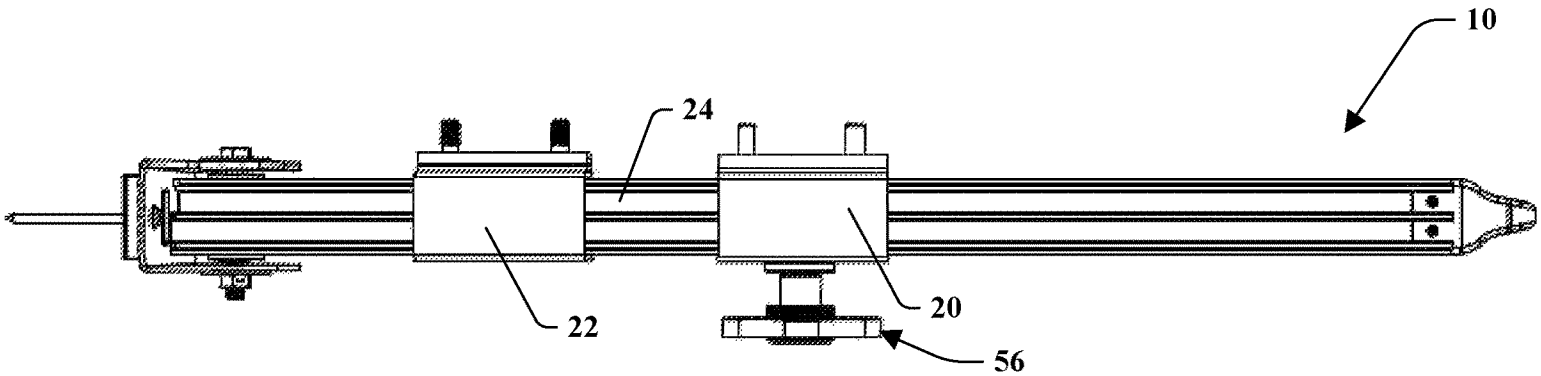
FIG. 13 is a left side view of the adjustable extension.

Turning now to FIGS. 2-6, the extension body 24 will be discussed in detail. The extension body 24 is movable relative to the upper and lower housings 20 and 22 from a retracted position shown in FIG. 2, to one or more extension positions, one of which is shown in FIG. 6, to a fully extended position shown in FIG. 7 where a top of the extension 24 is adjacent a top of the upper housing 20. In the fully extended position, a stop, such as fastener 110, is abutted by the upper housing 20, for example by an edge of the guide 58.

By way of example and not limitation, the extension body 24 can be an I-beam having a web 112 and a pair of flanges 114 and 116 as shown, a body with a rectangular cross-section, a body with a square cross-section, or a body with any other suitable shape and of any suitable size. Spaced along a length of the web 112 are a plurality of openings 118, such as a plurality of longitudinally and laterally spaced openings. The web 112 has a substantially flat surface with a surface texture, such as knurling or the like, to provide for secure gripping by the friction surface 80. The openings 118 may also having a texture, such as, but not limited to, ribs, knurling or the like as shown in FIG. 4 to provide for secure gripping by the friction surface 80 when the friction surface enters one or more of the openings 118. It is to be appreciated that there can be any suitable number of the plurality of openings 118, at any suitable spacing or pattern, and any described patterns or spacing or number of the openings 118 is not to be limiting on the subject innovation. For example, the openings 118 may have a triangular shape, a pill shape, etc. In an embodiment, the openings may be pill shaped and extend substantially the width of the extension body 24.

Attached to the bottom of the extension body 24 is a foot 130. The foot 130 has a pair of openings positioned on either side of the extension body 24 through which a fastener 132 extends to secure the foot 130 to the extension body 24 to allow the extension body 24 to pivot relative to the foot 130 when the foot 130 is flat on a surface to provide leveling and stabilizing. Attached to the bottom of the foot 130 is a friction pad 134 to provide grip, and extending through the foot and friction pad is a removable fastener 136, such as a nail that can be driven into the ground. In an example, the foot 130 can be moveable in various directions.

Attached to the top of the extension body 24 is a finger lift 140 having a body 142, which may be two inches or more in height, and an opening 144 defining an area for a user to grasp to move the extension body 24 in an upward direction to the retracted position shown in FIG. 2. The finger lift 140 includes one or more projections 146 that are received in slots 148 on each side of the extension body 24, and one or more projections 150 that are received in slots 152 on an inside of the extension body 24. The projections 146 and 150 receive fasteners to secure the finger lift 140 to the extension body 24. Alternatively, the finger lift 140 may be a loop or opening formed at the top of the extension body 24 or a flange, such as a flange a half inch or more wide, that protrudes perpendicular to the longitudinal direction.

During use of the ladder 12 with the extension 10, the user positions the ladder in the desired position while the extension body 24 is in the retracted position. Once the ladder is in the desired position, the user applies a force in the downward direction to release the extension body 24. When the extension body 24 is in the desired position, the user rotates the palm wheel 60, thereby turning the torque limiting knob 62 to turn the rod 64. The rod is moved in the direction perpendicular to the longitudinal direction and towards the extension body 24 thereby moving the shoe 82 in the direction perpendicular to the longitudinal direction. The shoe 82 then moves the friction surface 80 in the direction perpendicular to the longitudinal direction causing the friction surface 80 to press against the extension body 24 and/or into one or more of the openings 118 to prevent movement of the extension body 24 relative to the upper housing 20. When the friction surface 80 is pressed into the openings 118, the friction surface may continue to compress for a time after the initial pressing to increase friction providing an additional safety feature in case the user did not tighten the knob 62 enough. For instance, the friction surface may compress and press into or through openings 118. The extension 10 also prevents under-tightening of the screw clamp mechanism that can harm the user or over-tightening of the screw clamp mechanism that can damage the clamp.

When the user moves the ladder, the user rotates the palm wheel to move the rod 64 away from the shoe 82, thereby disengaging the friction surface 80 from the openings 118 and surface of the extension body 24. The user can the grasp the finger lift 140 and lift the extension body 24 upward until the retainer catch 102 engages the retainer 100, thus holding the extension body 24 in the retracted position 102 without having to engage the screw clamp assembly 56 and friction surface 80. This arrangement allows for one-handed operation.

In addition although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The best mode for carrying out the invention has been described for purposes of illustrating the best mode known to the applicant at the time and enable one of ordinary skill in the art to practice the invention, including making and using devices or systems and performing incorporated methods. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

Although certain embodiments have been shown and described, it is understood that equivalents and modifications falling within the scope of the appended claims will occur to others who are skilled in the art upon the reading and understanding of this specification.

What is claimed is:

1. An adjustable extension comprising:

a housing having a through passage;

an extension body extending through the through passage of the housing and movable relative to the housing from a retracted position to one or more extension positions;

a retainer attached to or integrally formed with the housing or the extension body; and a retainer catch attached to or integrally formed with the other of the housing or the extension body, wherein the retainer is a magnet that pulls on a magnetic surface of the retainer catch to engage the retainer catch when the extension body is moved from one of the one or more extension positions to the retracted position to retain the extension body in the retracted position, and wherein the retainer is force releasable to disengage from the retainer catch when a force is applied to the extension body to allow the extension body to move to one of the one or more extension positions.

2. The adjustable extension according to claim 1, wherein the through passage extends in a longitudinal direction and the extension body is movable relative to the housing in the longitudinal direction.

3. The adjustable extension according to claim 2, further including:

a screw clamp secured to and movable relative to the housing and having a rod with an axis perpendicular to the longitudinal direction; and a friction surface disposed within the through passage and positioned between the extension body and the screw clamp, wherein movement of the screw clamp in a direction perpendicular to the longitudinal direction and towards the extension body causes the friction surface to press against the extension body to prevent movement of the extension body relative to the housing.

4. The adjustable extension according to claim 3, wherein the screw clamp additionally includes a torque limiting knob that engages and moves the rod, and wherein the torque limiting knob is configured to release engagement with the rod when a torque above a predefined criteria is applied to the rod.

5. The adjustable extension according to claim 3, further including a shoe disposed within the through passage between the screw clamp and the friction surface, wherein movement of the screw clamp causes the rod to engage and move the shoe in the direction perpendicular to the longitudinal direction thereby causing the shoe to move the friction surface in the direction perpendicular to the longitudinal direction.

6. The adjustable extension according to claim 3, wherein the extension body includes a plurality of openings along a length of the extension body, and wherein the friction surface is configured to press against the extension body and into one or more of the openings to prevent movement of the extension body relative to the housing.

7. The adjustable extension according to claim 6, wherein the extension body is an I-beam having a web and a pair of flanges, and wherein the plurality of openings are in the web.

8. The adjustable extension according to claim 1, wherein the housing is an upper housing, and further including a lower housing attachable to a ladder leg and having a through passage through which the extension body extends, wherein the upper and lower housings are spaced from one another along a length of the ladder leg.

9. The adjustable extension according to claim 1, further including a finger lift secured to a top of the extension body for a user to grasp to move the extension body to the retracted position.

10. An adjustable extension for a ladder leg comprising:

a housing having a through passage extending in a longitudinal direction;

an extension body extending through the through passage of the housing and movable relative to the housing in the longitudinal direction from a retracted position to one or more extension positions to adjust a height of the ladder leg;

a screw-clamp secured to and movable relative to the housing;

a retainer attached to a bottom of the housing; and a retainer catch attached to the extension body below the bottom of the housing, wherein the retainer is a magnet that pulls on a magnetic surface of the retainer catch to engage the retainer catch when the extension body is moved from one of the one or more extension positions to the retracted position to retain the extension body in the retracted position, and wherein the retainer is force releasable to disengage from the retainer catch when a force is applied to the extension body to allow the extension body to move to one of the one or more extension positions.

11. The adjustable extension according to claim 10, wherein the retainer is attached to the housing in a fixed position.

12. An adjustable extension comprising:

a housing having a through passage;

an extension body extending through the through passage of the housing and movable relative to the housing from a retracted position to one or more extension positions;

a retainer attached to or integrally formed with the housing or the extension body in a fixed position;

a retainer catch attached to or integrally formed with the other of the housing or the extension body in a fixed position, a screw clamp secured to and movable relative to the housing and having a rod with an axis perpendicular to the longitudinal direction of the housing, and a friction surface disposed within the through passage and positioned between the extension body and the screw clamp, wherein the retainer engages the retainer catch when the extension body is in the retracted position to retain the extension body in the retracted position, and wherein movement of the screw clamp in a direction perpendicular to the longitudinal direction and towards the extension body causes the friction surface to press against the extension body to prevent movement of the extension body relative to the housing.

13. The adjustable extension according to claim 12, wherein the screw clamp additionally includes a torque limiting knob that engages and moves the rod, and wherein the torque limiting knob is configured to release engagement with the rod when a torque above a predefined criteria is applied to the rod.

14. The adjustable extension according to claim 12, further including a shoe disposed within the through passage between the screw clamp and the friction surface, wherein movement of the screw clamp causes the rod to engage and move the shoe in the direction perpendicular to the longitudinal direction thereby causing the shoe to move the friction surface in the direction perpendicular to the longitudinal direction.

15. The adjustable extension according to claim 12, wherein the housing is an upper housing, and further including a lower housing attachable to a ladder leg and having a through passage through which the extension body extends, wherein the upper and lower housings are spaced from one another along a length of the ladder leg.

16. The adjustable extension according to claim 12, further including a finger lift secured to a top of the extension body for a user to grasp to move the extension body to the retracted position.

17. The adjustable extension according to claim 12, wherein the extension body includes a plurality of openings along a length of the extension body, and wherein the friction surface is configured to press against the extension body and into one or more of the openings to prevent movement of the extension body relative to the housing.

18. The adjustable extension according to claim 17, wherein the extension body is an I-beam having a web and a pair of flanges, and wherein the plurality of openings are in the web.

19. The adjustable extension according to claim 12, wherein the retainer is attached to or integrally formed with a bottom of the housing, and the retainer catch is attached to or integrally formed with the extension body below the bottom of the housing.

* * * * *